US005128502A

United States Patent [19]

Hux

[11] Patent Number: 5,128,502

[45] Date of Patent: Jul. 7, 1992

[54] THREE-POLE, GAS-INSULATED SWITCH ARRANGEMENT

[75] Inventor: Guido Hux, Unterentfelden, Switzerland

[73] Assignee: Sprecher Energie AG, Oberentfelden, Switzerland

[21] Appl. No.: 541,802

[22] Filed: Jun. 21, 1990

[30] Foreign Application Priority Data

Jun. 30, 1989 [CH] Switzerland ..... 02451/89-1

[51] Int. Cl.[5] ..... H01H 33/53

[52] U.S. Cl. ..... 200/145; 200/148 R; 200/148 F; 200/148 B; 200/148 D

[58] Field of Search ..... 200/145, 148 F, 146 R, 200/148 R, 148 B, 148 D

[56] References Cited

U.S. PATENT DOCUMENTS 4,206,330 6/1980 McConnell et al. ..... 200/147 R
4,788,392 11/1988 Asai ..... 200/148 R

FOREIGN PATENT DOCUMENTS 0094858 11/1983 European Pat. Off. .
2027375 9/1970 France .
61-11868 4/1986 Japan .

*Primary Examiner*—A. D. Pellinen
*Assistant Examiner*—D. Le
*Attorney, Agent, or Firm*—Fleit, Jacobson, Cohn, Price, Holman & Stern

[57] ABSTRACT

A three-pole switch arrangement has for each pole a pole housing, onto which collar-shaped extensions, protruding on the underside, are formed. Provided in the extensions are screw holes, the graduation of which corresponds to the screw coupling, by which the mechanism housing has been screwed to the pole housing. The outer switch poles are oriented outwardly by one graduation and are fastened to the frame by means of screws. Counter to this inclined position, the mechanism housing, rotated by one graduation, is screwed onto the pole housing. It is consequently possible to use the same parts for all three switch poles, and also to transport the switch arrangement pole-by-pole.

8 Claims, 3 Drawing Sheets

THREE-POLE, GAS-INSULATED SWITCH ARRANGEMENT

BACKGROUND OF THE INVENTION

The present invention relates to a three-pole, gas-insulated switch arrangement

A switch arrangement of this type is known, for example, from U.S. Pat. No. 4,788,392. Such switch arrangement has metallic encapsulation for each pole in the form of a cylindrical pole housing which is tightly connected at both ends to one plate common to all three poles, namely a cover plate at one end and a mechanism housing plate at the other end. The interrupter elements arranged in the pole housings are supported on these plates via insulators. The plates are fastened to a frame and bear the encapsulation. On the side facing away from the pole housings, the mechanism housing plate carries a mechanism housing, common to all poles, for a switch mechanism. The interior of the mechanism housing is connected to the interior of the three pole housings via openings in the mechanism housing plate. Switching rods coupled at one end to the switch mechanism and at the other end to the interrupter elements run through these openings. The switch mechanism is passed in gas-tightly manner through the wall of the mechanism housing and is connected to a drive common to all poles. The axes of the respective two bushings arranged on a pole housing éxtend in an axial plane of the pole housing. In order to keep the basic area required for the switch arrangement as small as possible, the axial plane of the middle pole extends vertically and the axial planes of the outer poles are inclined outwards with respect thereto.

The three poles of the known switch arrangement can be composed of identical parts. However, the encapsulation of all three poles forms a unit, which cannot be taken apart for transport without the possibility of air and moisture penetrating the interior of the encapsulation. If the switch arrangement is too bulky to be transported as a whole unit, it must be split into components. After assembly at the installation site, it is necessary for the interior of the encapsulation to be evacuated and dried again, which entails a considerable outlay.

SUMMARY OF THE INVENTION

It is object of the present invention to provide a switch arrangement of the generic type having poles of identical parts which can be assembled pole-by-pole and transported pole-by-pole without it being possible for air to reach the interior.

In a switch according to the invention each pole has an independent encapsulation. All poles are made of identical parts. The mechanism housing is screwed on to the respective pole housing in each case rotated counter to the inclined position of said pole housing. This is feasible without difficulty since the graduations of the screw holes and the screw coupling of the mechanism housing are identical to the pole housings. The interrupter elements are supported on the pole housings, so that the position of the mechanism housings has no influence on the position of the interrupter elements.

In a preferred embodiment of the switch arrangement according to the invention, the screw couplings of the mechanism housings and covers to the pole housings and the pole housings to the frame are separate from one another. When assembling at the installation site, it is then not necessary for screws holding the encapsulation together to be removed..

The present invention is particularly advantageous in the case of switch arrangements in which all three poles are driven by a common drive. In this case, the mechanism housings can be aligned with one another without difficulty. With a switch arrangement of this design, the switch mechanism is advantageously connected via a detachable rod to the common drive. By detaching the rod, the individual poles can be transported independently of one another.

Further preferred embodiments of the present invention are specified in the further dependent claims.

BRIEF DESCRIPTION OF DRAWING

The invention will now be described in greater detail with reference to an exemplary embodiment illustrated in the drawings, in which, in purely diagrammatic form.

DESCRIPTION OF PREFERRED EMBODIMENT

Figure 1:
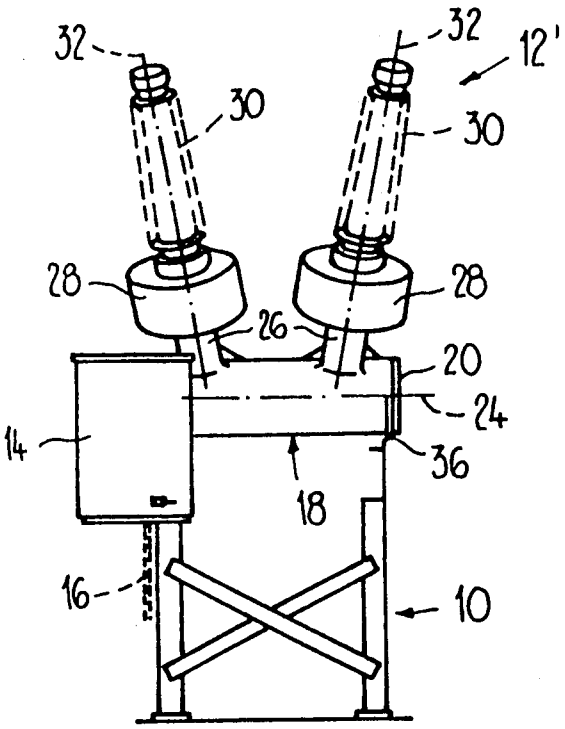
FIGS. 1 and 2 are a side view and end view respectively of a three-pole switch arrangement.
Figure 2:
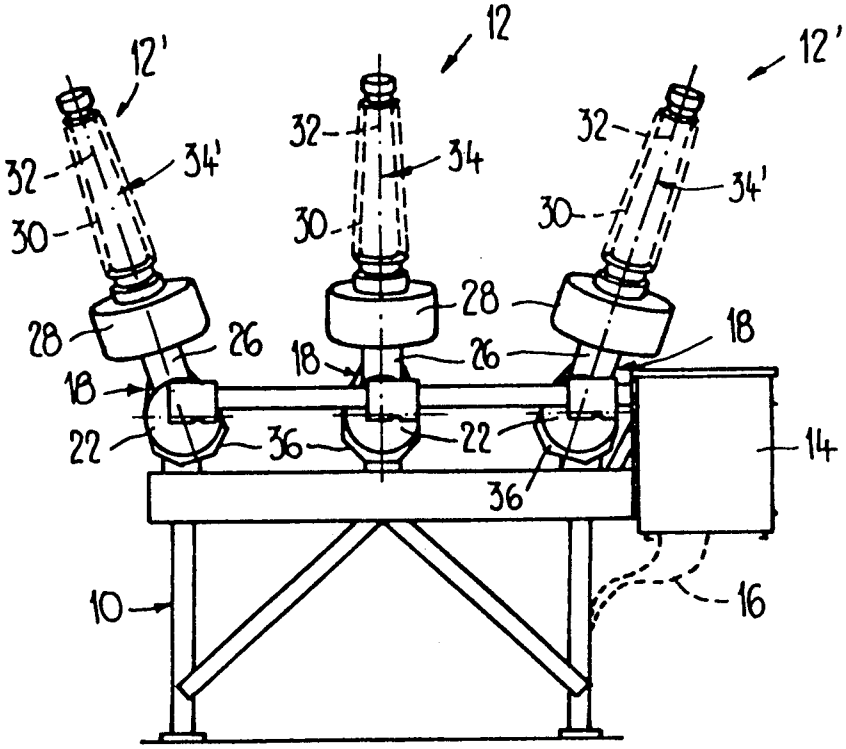

The switch arrangement illustrated in FIGS. 1 and 2 has three switch poles 12, 12' supported by a frame 10. A drive 14 which is common to all switch poles 12, 12' is also fastened to the frame 10. Control and feeder lines for the drive 14 are indicated by dashed lines and denoted by 16. The drive 14 is a generally known spring-tension stored-energy drive.

Each switch pole 12, 12' is individually encapsulated, filled with SF6 insulating gas subject to overpressure, and has an essentially cylindrical, metallic pole housing 18, for example cast from aluminum. In each case at one end a separate cover 20 and at the other end a separate mechanism housing 22 is screwed gas-tightly to the pole housing 18. The pole housings 18 are arranged adjacent to one another at the same level with mutually parallel longitudinal axes 24. Spaced from one another in the direction of the longitudinal axis 24, in each case two bushing tubes 26 are formed onto the pole housings 18, on which tubes current transformer arrangements 28 are seated in a known manner at their free ends the arrangements 28 carry bushing insulators 30. The longitudinal axes 32 of the respective mutually flush bushing tubes 26 and bushing insulators 30 of a switch pole 12 lie in an axial plane of the pole housing 18 which is indicated by dot-dashed lines in FIG. 2 and is denoted by 34. Seen in radial direction, the longitudinal axes 32 arranged in an axial plane 34 diverge (FIG. 1) from one another. This results in a sufficiently large insulation distance between the free ends of the corresponding bushing insulators 30. The axial plane 34 of the middle switch pole 12 extends in vertical direction, while the axial planes 34 of the two outer switch poles 12' are outwardly inclined with respect to the latter. The pole housings 18 can consequently be arranged adjacent to one another at a small spacing while keeping the necessary insulation distance between the free ends of the bushing insulators 30 of adjacent switch poles 12, 12'. The base area required for the switch arrangement can thus be kept small. On the side opposite the bushing tubes 26, in their axial end regions, the pole housings 18 have collar-shaped extensions 36 protruding in radial direction, which extend in each case along a cross-sectional plane approximately over half the circumference of the pole housings 18. The switch poles 12 are fastened to the frame 10 via said extensions 36, as is illustrated in detail in FIG. 3.

Figure 3:
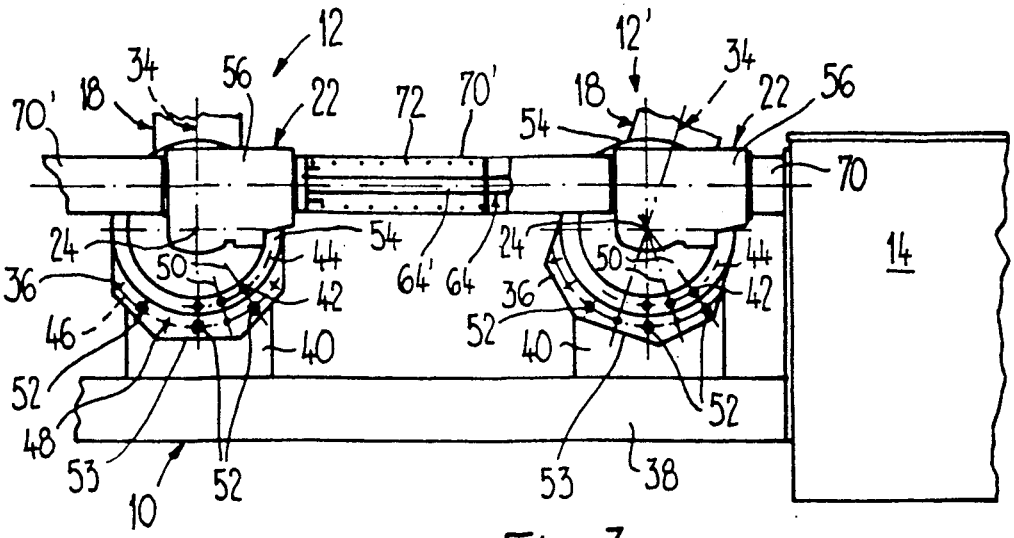
FIGS. 3 and 4 are a side view and plan view, respectively partially in section, of part of the switch arrangement and the rod.

FIG. 3 shows an enlarged view of part of the switch poles 12', 12 of FIG. 2, namely the one adjacent to the drive 14 and the middle switch. This figure shows an upper crosspiece 38 of the frame 10, said crosspiece extending in horizontal direction and at right angles to the longitudinal axes 24 of the pole housings 18, on which crosspiece a tongue-shaped fastening element 40 that protrudes in the upwards direction is arranged for one pole. The free end of each of the fastening elements 40 is matched approximately to the outer contour of the pole housings 18.

The mechanism housings 22 are fastened to the pole housings 18 by means of screws 42 which are evenly spaced from one another and lie on a circle 44, the center of which lies on the longitudinal axis 24 of the pole housing 18. Seven screw holes 48 are made on the extension 36 on a circular arc 46, concentric to the circle 44, having a greater radius. The graduation of the screw holes 48 corresponds to the graduation of the screws 42, as is indicated by the rays 50 starting from the longitudinal axis 24. The screw holes 48 are arranged symmetrically with respect to the axial plane 34. Each fastening element 40 has three openings, not visible in the figures, which are flush with three screw holes 48, spaced from one another in each case by two graduations, in the extensions 36. The middle opening lies in each case perpendicularly below the longitudinal axis 24. Each extension 36 is fastened to the respective fastening element 40 with three screws 52, which are passed through the aforesaid openings and the corresponding screw holes 48. It should be noted that in the case of the middle switch pole 12, the axial plane 34 of which extends vertically, no screws consequently run through the two outermost screw holes 48. The pole housing 18 of the switch pole 12' adjacent to the drive 14 is rotated by one graduation of the screw holes 48 in the clockwise direction. The extension 36 is again screwed by means of three screws 53 to the respective fastening element 40, these screws 52 assuming the same position with respect to the fastening element 40 as in the case of the middle switch pole 12. It should be noted that as a result o the rotation of the pole housing 18 by one graduation, two screw holes 48 are free on the one side and no screw hole 48 is free at the other end of the extension 36. The switch pole 12', not shown in FIG. 3, which is furthest away from the drive 14 is fastened in an analogous manner rotated by one graduation in the clockwise direction on the frame 10.

The mechanism housings 22 of the outer switch poles 12, are n each case rotated by one graduation counter to the inclined position of the pole housings 18 and are screwed to the latter. As is evident particularly from FIGS. 2 and 3, all mechanism housings 22 thus have the same position. For reasons of completeness, it will also be mentioned that the extensions 36, adjacent to the cover 20, and the corresponding fastening elements 40 are of identical design. The covers 20 are likewise screwed to the pole housings 18, this screw coupling having the same graduation as the screw coupling of the mechanism housings 22 to the pole housing 18. If this should become necessary for any reason, in the case of the inclined switch poles 12', it is thus also possible to screw the covers 20 rotated counter to the inclined position onto the respective pole housings 18.

The two extensions 36 of each pole housing 18 have at their lower ends a support face 53, which lies in a plane extending parallel to the longitudinal axis 24 and at right angles to the axial plane 34 in which the longitudinal axes 32 of the bushing insulators 30 lie. The ready-assembled switch poles 12, 12' can be placed on the support faces 53 for storage or transport.

Figure 4:
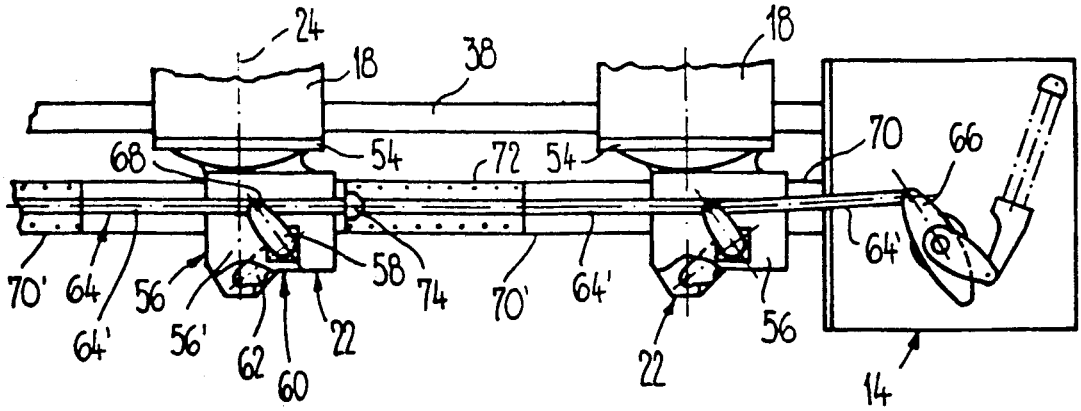

The mechanism housings 22 have a cover-shaped flange part 54, by means of which they are screwed to the pole housings 18, and a housing part 56 formed thereon, protruding in the direction of the longitudinal axis 24, as is also evident from FIG. 4. A pivoted lever 58 of a switch mechanism 60 is rotatably mounted on each housing part 56. A pivot shaft, not shown in FIGS. 3 and 4, rotatably connected to the pivoted lever 58 is passed in gas-tight manner through the wall 56' of the housing part 56. In the interior of the housing part 56, a onearm lever 62 is rotatably fastened to the pivot shaft. The pivoted lever 58 and lever 62 are offset by approximately 90° to one another. The pivoted levers 58 are coupled to one another via a rod 64 and to a drive lever 66 of the drive 14. The rod 64 has a plurality of rod sections 64' which are connected to one another via bolts 68 and are detachably connected to the pivoted levers 58. The rod 64 extends in protective tubes 70, 70' in the region between the drive 14 and the mechanism housing 22 of the switch pole 12' adjacent to the drive 14, and in the region between the mechanism housings 22 of the switch poles 12, 12'. Arranged in the protective tubes 70, between the mechanism housings 22 is in each case a shut-off pressure spring 72 which encloses the rod 64, and which is supported at one end on the respective protective pipe 70' and at the other end on the rod 64 via a rod flange 74.

In the position of the drive lever 66 shown in FIG. 4, the switch arrangement is switched off. The shut-off pressure springs 72 are in this case only slightly pretensioned. When switched on, the drive lever 66 rotates by approximately 60° in the clockwise direction, as a result of which the switch mechanisms 60 are pivoted in the clockwise direction and the shut-off pressure springs 72 are tensioned. For switching off, the drive lever 66 is released in a known manner so that, together with the switch mechanisms 60, the lever pivots back into the position shown in FIG. 4 utilizing the energy stored in the shut-off pressure springs 72.

Figure 5:
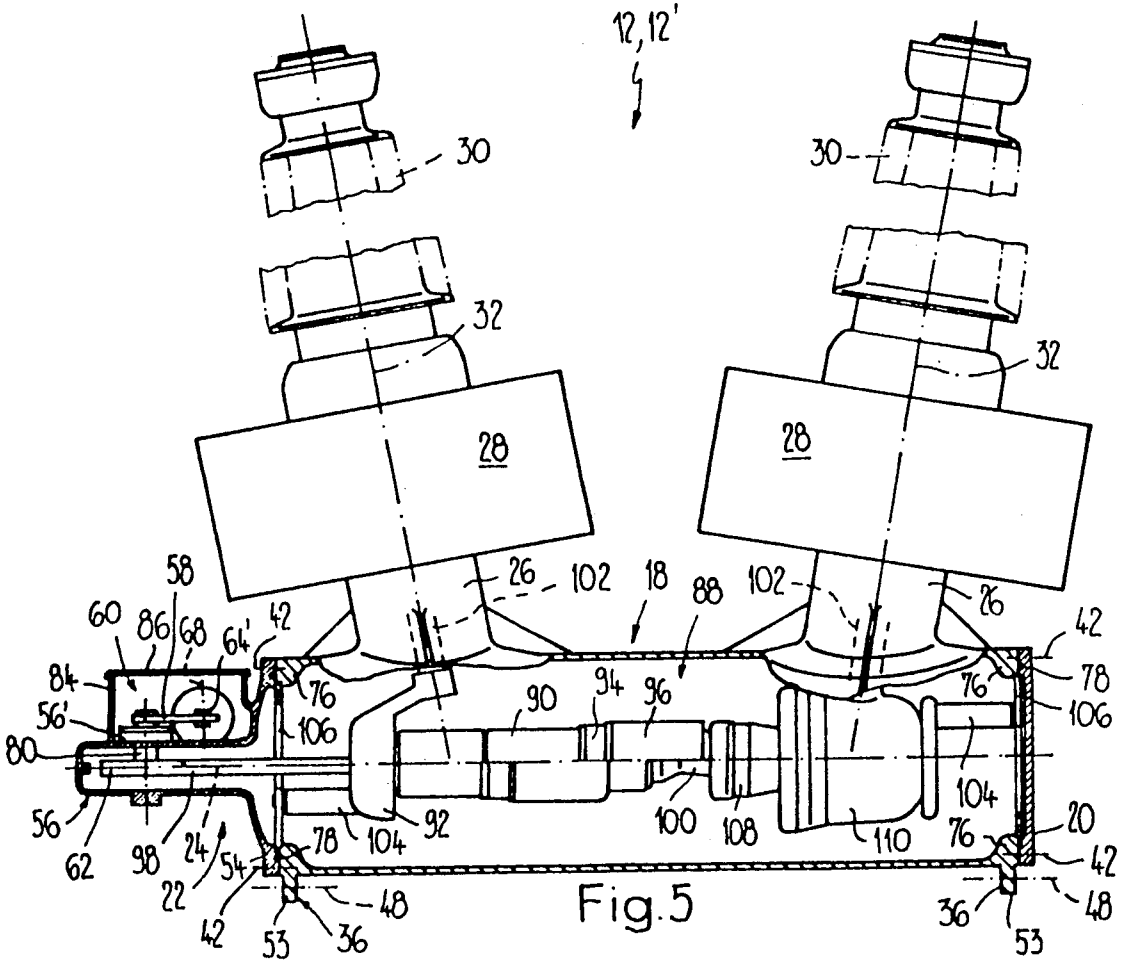
FIG. 5 is a partial longitudinal section through a switch pole.

A switch pole 12, 12' is shown in, partially sectional side view in FIG. 5. The essentially cylindrical pole housing 18 has bushing tubes 26 protruding upwards, on which the current transformer arrangements 28 and bushing insulators 30 are arranged. At its axial ends, the pole housing 18 has inwardly directed flanges 76, against which the cover 20 or the flange part 54 of the mechanism housing 22 rests. The cover 20 and the mechanism housing 22 are fastened to said flanges 76 by means of the screws 42, only indicated in the figure by a dash, the screws 42 engaging in corresponding, blind-type threaded holes in the flanges 76. A gas-tight connection between the pole housing 18 and the cover 20 or the mechanism housing 22 is ensured by means of sealing rings 78 and said blind-type threaded holes. In the region of the flanges 76, on the side opposite the bushing tubes 26, the extensions 36 protruding in radial direction are shown with the screw holes 48, which are only shown with dot-dashed lines, and the support faces 53.

The pivot shaft 80 of the switch mechanism 60 is rotatably mounted in the top wall 56' of the housing part 56 and is passed in gas-tight manner through the latter. The lever 62 is arranged so as to be non-rotatable on pivot shaft 80 at the level of the longitudinal axis 24 in the interior of the mechanism housing 22. In the outer end region, the pivot lever 58 is seated non-rotatably on the pivot shaft 80, which lever is articulated on the rod sections 64, by means of the bolt 68, indicated by dot-dashed lines. Protective walls 84 are formed in a box-shaped manner on the topside on the flange part 54 and the housing part 56, respectively, which protective walls, together with the cover 86, protect the switch mechanism 60 from the effects of weather.

Arranged in the interior of the pole housing 18 is an interrupter element 88, the longitudinal axis of which coincides with the longitudinal axis 24 of the pole housing 18. This interrupter element 88 is a generally known SF6 puffer circuit-breaker. The interrupter element 88 is shown in its switched-on position above the longitudinal axis 24, and in its switched-off position below the longitudinal axis. Contact fingers 94, which are arranged on an electroconductive compression cylinder 96, slide on a contact tube 90, which is seated on a contact bracket 92. Provided in the interior o the compression cylinder 96 is a piston, not shown, which is supported at the free end of the contact tube 90. A switching rod 98 is passed freely movably through the piston in the direction of the longitudinal axis 24, which switching rod engages at the one end on the lever 62 and at the other end on the compression cylinder 96. Fastened to the free end of the compression cylinder 96 is an insulated nozzle 100, through which the switching gas compressed in the compression cylinder 96 emerges in a known manner when switching off, and cools and extinguishes the arc produced between the arc contacts (not shown). The connecting bracket 92 is electrically connected at its top end to a conductor 102, which extends through the bushing tube 26, the current transformer arrangement 28 and the bushing insulator 30 to the top end of the bushing insulator 30. The connecting bracket 92 is supported via insulators 104, of which only one is shown in FIG. 5, on a crosspiece 106 which is fastened to the flange 76 of the pole housing 18, by means of screws for example.

On the blow-out side of the nozzle 100, the interrupter element 88 has a counter-contact part 108 and gas conducting part 110. The aforesaid are made of an electroconductive material, preferably aluminum, and are electrically connected to a corresponding further conductor 102. The counter-contact and gas conducting part 108, 110 are supported via further insulators 104 on a further crosspiece 106, which is likewise fastened to the respective flange 76.

The switch pole 12, 12' shown in FIG. 5 can be ready assembled and set at the factory. The only thing that needs to be noted is in which rotation position with respect to the axial plane 34 the mechanism housing 22 is to be screwed firmly to the pole housing 18 (cf. FIGS. 2 and 3). The rotation position of the switch mechanism 60 with respect to the interrupter element 88 has no influence on its functioning, since the switching rod 98 is articulated on the lever 62 in the region of the longitudinal axis 24. Moreover, in the case of SF6 puffer circuit-breakers, the rotation position of the compression cylinder 96 with respect to the contact tube 90 is not predetermined, so that the rotation position of the switching rod 98 is freely selectable.

For transport to the installation site, the switch poles 12, 12' are placed adjacent to one another resting on the support faces 53 with axial planes 34 running in perpendicular direction, or are packed pole-by-pole in crates. After the frame 10 has been assembled at the installation site, the drive 14 is fastened to the latter on the endface. The switch pole 12' adjacent to the drive 14 is then screwed to the frame 10. The rotation position of the mechanism housing 22 with respect to the pole housing 18 defines the inclined position of the switch pole 12, and the switch pole 12' itself. Following this, the protective tube 70 is mounted between the drive 14 and the mechanism housing 22 and the respective rod section 64' is inserted into the protective tube 70. After attachment of the protective tube 70', to be connected to the mechanism housing 22, including insertion of the respective rod section 64' into the mechanism housing 22, the two rod sections 64' are articulated on the pivot lever 58 and on the drive lever 66, respectively, by means of a bolt 68. With the insertion of the respective rod section 64' into the mechanism housing 22, the middle switch pole 12 is now placed on the fastening elements 40 in the same manner and screwed to the latter. Analogously, the further protective tube 70', together with the remaining rod sections 64' and the third switch pole 12', is also mounted. In order to monitor the insulation gas, and possibly for refilling the latter, a tubing can also be inserted. However, this can be carried out without the insulation gas escaping from the encapsulation.

If the pole housing has outer flanges at its axial ends to which the mechanism housing and the cover are screwed, then the extensions can be formed onto these outer flanges. It is of course possible for the extensions 36 to be connected to the fastening element 40 with more or fewer than three screws.

More or fewer screw holes 48 must accordingly be provided, whereby in each case at least two screw holes 48 more must be available than are required for the fastening of the pole housing to the frame 10, in order to permit the perpendicular position, inclined at both sides, of the switch poles 12, 12'. It is of course also possible to multiple of the graduation; a correspondingly greater number of screw holes must be provided in the extensions. For reasons of completeness, it should also be mentioned that interrupter elements of any design, for example vacuum interrupters, can be built into the pole housing 18. The present invention may of course also be employed in switch arrangements with a drive for each pole.

All the switch poles of a switch arrangement having an axial plane extending in vertical direction can of course be screwed to a frame.

What is claimed is:

1. A three-pole, gas insulated switch arrangement comprising an inner pole and outer poles, a metallic encapsulating means supported on a frame, said encapsulation means comprising for each pole an essentially cylindrical pole housing connected in gas-tight manner at one end to a cover and at the other end to a mechanism housing for a switch mechanism, interrupter elements arranged in the respective pole housings and supported on the encapsulation means via insulators, the pole housings being arranged adjacent one another with mutually parallel longitudinal axes and each being connected to two bushings, the bushings having longitudinal axes which lie in an axial plane of the respective pole housing, the axial plane of the inner pole extending essentially vertically and the axial planes of the outer poles extending outwardly at an incline with respect to the inner pole, wherein the interrupter elements are supported on the pole housings, the respective cover and the respective mechanism housing are fastened to the respective pole housing each by means of a circular arrangement of evenly distributed screw couplings, and the pole housings are fastened to the frame by a further circular arrangement of screw couplings having the same circumferential graduations therebetween as the screw couplings which fasten the mechanism housings to the pole housings, the outer poles having axial planes inclined by at least one graduation of the screw couplings relative to the inner pole.

2. A switch arrangement as claimed in claim 1, wherein the pole housings each have two mutually spaced extensions which protrude outwardly in radial direction, in each case lying essentially in a cross-sectional plane, and being provided with screw holes of said circular arrangement of couplings whereby the pole housings are screwed to the frame through said extensions.

3. A switch arrangement as claimed in claim 2, wherein the pole housings have axial end regions with inner flanges for supporting the interruptor elements and for screwing on the covers and mechanism housings.

4. A switch arrangement as claimed in claim 2, wherein said extensions are formed on axial end regions of the pole housings.

5. A switch arrangement as claimed in claim 2, wherein the pole housings have axial end regions with outer flanges for screwing on the covers and mechanism housings, and the extensions are formed on the outer flanges.

6. A switch arrangement as claimed in claim 2, wherein the extensions have support faces which lie in a plane extending at right angles to the axial plane of the respective pole housing and parallel to the longitudinal axis of the pole housing.

7. A switch arrangement as claimed in claim 2, wherein the screw holes in the extensions are arranged on a circular arc which is coaxial to the pole housing, and the number of screw holes is at least two more than the number of screws used for fastening the housing to the frame.

8. A switch arrangement as claimed in claim 1, wherein the switch mechanisms are connected to a common drive by a detachable rod.

* * * * *